United States Patent [19]

Simmons et al.

[11] Patent Number: 4,616,981

[45] Date of Patent: Oct. 14, 1986

[54] PUMPING APPARATUS WITH A DOWN-HALE SPRING LOADED PISTON ACTUATED BY FLUID PRESSURE

[76] Inventors: Eugene D. Simmons, 1108 N. Pennsylvania; Graham C. Thomson, III, 1502 N. Ohio; Richard J. Reynaud, 1502 N. Ohio, all of Roswell, N. Mex. 88201

[21] Appl. No.: 662,963

[22] Filed: Oct. 19, 1984

[51] Int. Cl.[4] ..... F04B 47/08

[52] U.S. Cl. ..... 417/378; 417/390

[58] Field of Search ..... 417/390, 383, 378

[56] References Cited

U.S. PATENT DOCUMENTS

| | | | |
|---|---|---|---|
| 376,382 | 1/1888 | Hearn | 417/378 |
| 436,708 | 9/1890 | Hearn | 417/378 |
| 1,761,081 | 6/1930 | Leschen | 417/378 |
| 2,058,455 | 10/1936 | Huff | 417/378 |
| 2,527,184 | 10/1950 | Gerhold | 417/378 X |
| 4,013,385 | 3/1977 | Peterson | 417/378 X |
| 4,403,919 | 9/1983 | Stanton et al. | 417/390 X |
| 4,490,095 | 12/1984 | Soderberg | 417/390 |

*Primary Examiner*—Leonard E. Smith
*Attorney, Agent, or Firm*—Romney Golant Martin Seldon & Ashen

[57] ABSTRACT

A pumping apparatus (10) is disclosed which includes a downhole reservoir unit (20), a pumping unit (18) and a power unit (102). The reservoir unit (20) has a piston assembly (70) with a top piston (72) and a bottom piston (74). A storage chamber (82) is defined between the two pistons (72, 74) which is variable in volume as the piston assembly moves from the rest position to a pumping position where a helical spring (98) is compressed. The piston assembly (70) is moved by fluid in a tubing string (22) through reciprocal motion of a pulser piston (48). As the piston assembly (70) is moved downwardly, fluid from the reservoir passes through a check valve into the storage chamber (82). When the piston assembly (70) is in the pumping position, the pulser piston (48) is retracted and the helical spring (98) drives the piston assembly (70) upward. The volume of the storage chamber (82) decreases and fluid is pumped from the storage chamber through the tubing string to the surface. The movement of the pulser piston is controlled by a double acting hydraulic cylinder assembly (30) which has a stroke sufficient to move the piston assembly (70) between the rest and pumping position despite the presence of gas in the fluid in the tubing string (22). The fluid pumped from the reservoir can be used to cool the hydraulic fluid in the hydraulic fluid reservoir (108).

11 Claims, 6 Drawing Figures

PUMPING APPARATUS WITH A DOWN-HALE SPRING LOADED PISTON ACTUATED BY FLUID PRESSURE

TECHNICAL FIELD

This invention relates to the pumping of fluid from a reservoir to a collection location, and in particular to a pump for use in pumping water or oil from a well to the surface.

BACKGROUND ART

Many different types of pumps exist. One common type is used for pumping fluids from a remote location, such as the bottom of a water well or oil well to a collection location, such as a surface mounted reservoir container. One difficult problem arises because the fluid reservoir in a well may be quite deep in the ground, requiring the pump to produce sufficient energy to lift the fluid from the reservoir to the surface.

One common pump for use in the water and oil well environment is the common pump jack. A frame is mounted at the surface near the well and mounts a pivotal rocker arm. One end of the rocker arm support the sucker rods which extend into the well to the fluid reservoir. Counterweights at the other end of the rocker arm balance the arm. A pumping unit is mounted at the lower end of the sucker rod in the well. A motor is then used to rock the arm about its pivotal axis, causing a reciprocating motion in the pumping unit down-hole to lift fluid to the surface. While the pump jack has proven generally satisfactory for many years, it is a massive unit and can often be 2 to 3 stories high. This causes the pump jack to be expensive and difficult to move between wells.

Attempts have been made to improve upon the pump jack for use in the well environment. One such device is disclosed and claimed in U.S. Pat. No. 4,295,799, issued Oct. 20, 1981. This pump uses a sonic pressure wave generated by a surface unit to pump water from within the well. However, one drawback of this pump, as well as many other designs of a similar nature, is the problem of gas locking. In other words, the operation of these pumps relies upon a solid column of liquid extending between the surface unit and the downhole unit. The presence of gas entrained within the fluid decreases the pumping action and, can actually cause the pump to lock or cease functioning. This occurs because the surface unit cannot provide pumping energy to the downhole unit when so much gas is present that the pumping energy produced at the surface is absorbed in the compression and expansion of the gaseous pockets instead of the downhole unit.

A need therefore exist for an improved pumping unit which incorporates the advantages of the prior art in having a surface powered pump while avoiding the prior art disadvantages of complexity, weight, and sensitivity to gas presence within the fluid in the well.

SUMMARY OF THE INVENTION

In accordance with one aspect of the present invention, a pump is provided for pumping fluids from a reservoir to a collection location. Tubing interconnects the reservoir and collection location. The pump includes a reservoir unit and a pumping unit. The reservoir unit is positioned down-hole in the wall casing to be located proximate the reservoir and includes a housing secured to the tubing with the interior of the housing being in fluid communication with the passage in the tubing. The interior of the housing also defines a top cylinder and a bottom cylinder with the cross section of the bottom cylinder being larger than the cross section of the top cylinder. A piston assembly is mounted within the housing which includes a top piston, a bottom piston and a member interconnecting to the top and bottom pistons. Each of the pistons has an outer face and an inner face. The inner faces of the pistons and the housing define a storage chamber therebetween. The outer face of the top piston is exposed to the fluid in the passage of the tubing. The outer face of the lower piston is exposed to fluid in the reservoir through an opening formed in the housing permitting fluid from the reservoir to enter the interior of the housing. The piston assembly is movable within the housing and relative to the housing from a rest position to increase the volume of the storage chamber. A spring structure is provided which acts between the housing and the piston assembly to urge the piston assembly to the rest position. A first check valve structure is provided for permitting flow of fluid from the reservoir to the storage chamber when the storage chamber fluid pressure is less than a reservoir fluid pressure and further for preventing the reverse flow. A second check valve structure is provided for permitting flow of fluid from the storage chamber to the passage within the tubing when the storage chamber fluid pressure exceeds the fluid pressure in the tubing passage.

The pumping unit is positioned along the tubing remote from the reservoir unit and includes a pulser piston having a first face. The pumping unit also includes a structure defining a pulser piston cylinder with the pulser piston designed for sliding sealed motion along the pulser piston cylinder. The structure is secured to the tubing so that the first face of the pulser piston is in fluid communication with the fluid in the tubing. A valve is positioned in fluid communication with the passage in the tubing and is operable between closed and open positions. The valve in the closed position stops flow through the tubing to the collection location and in the open position allows fluid through the tubing to the collection location. Pumping structure is provided for moving the pulser piston in a first direction relative to the pulser piston chamber with the valve closed to pressurize the fluid in the tubing between the valve and reservoir unit to a predetermined pressure. The predetermined pressure acts against the outer face of the top piston to move the piston assembly away from the rest position, the volume of the storage chamber increasing and fluid from the reservoir passing through the first check valve structure to maintain the storage chamber filled with fluid. The movement of the piston assembly from the rest position stores potential energy in the spring structure. The pumping structure permits the pulser piston to move in the opposition direction relative to the pulser piston cylinder with the valve open. The spring means urge the piston assembly to the rest position, causing the storage chamber to reduce in volume and pumping fluid from the storage chamber through the tubing to the collection reservoir.

In accordance with another aspect of the present invention, the pumping means include a double acting hydraulic cylinder with a piston interconnected to the pulser piston. The stroke of the double acting hydraulic cylinder is sufficient to generate the predetermined pressure within the tubing despite the presence of gas within the fluid in the tubing.

In accordance with another aspect of the present invention, a hydraulic reservoir is provided for use with the double acting hydraulic cylinder. The reservoir includes a container for holding the hydraulic fluid and a passage about the container for passing the fluid pumped from the reservoir to cool the hydraulic fluid within the container.

BRIEF DESCRIPTION OF THE DRAWINGS

For a more complete understanding of the present invention and for the advantages thereof, reference is now made to the following Detailed Description taken in conjunction with the accompanying drawings in which.

FIGS. *3a* and *3b* illustrate the operation of the pumping apparatus with a pulser piston driven downwardly to fill the storage chamber in FIG. *3a* and the spring pumping the fluid from the storage chamber to the collection location at the surface in FIG. *3b;*

Figures 1, 2:
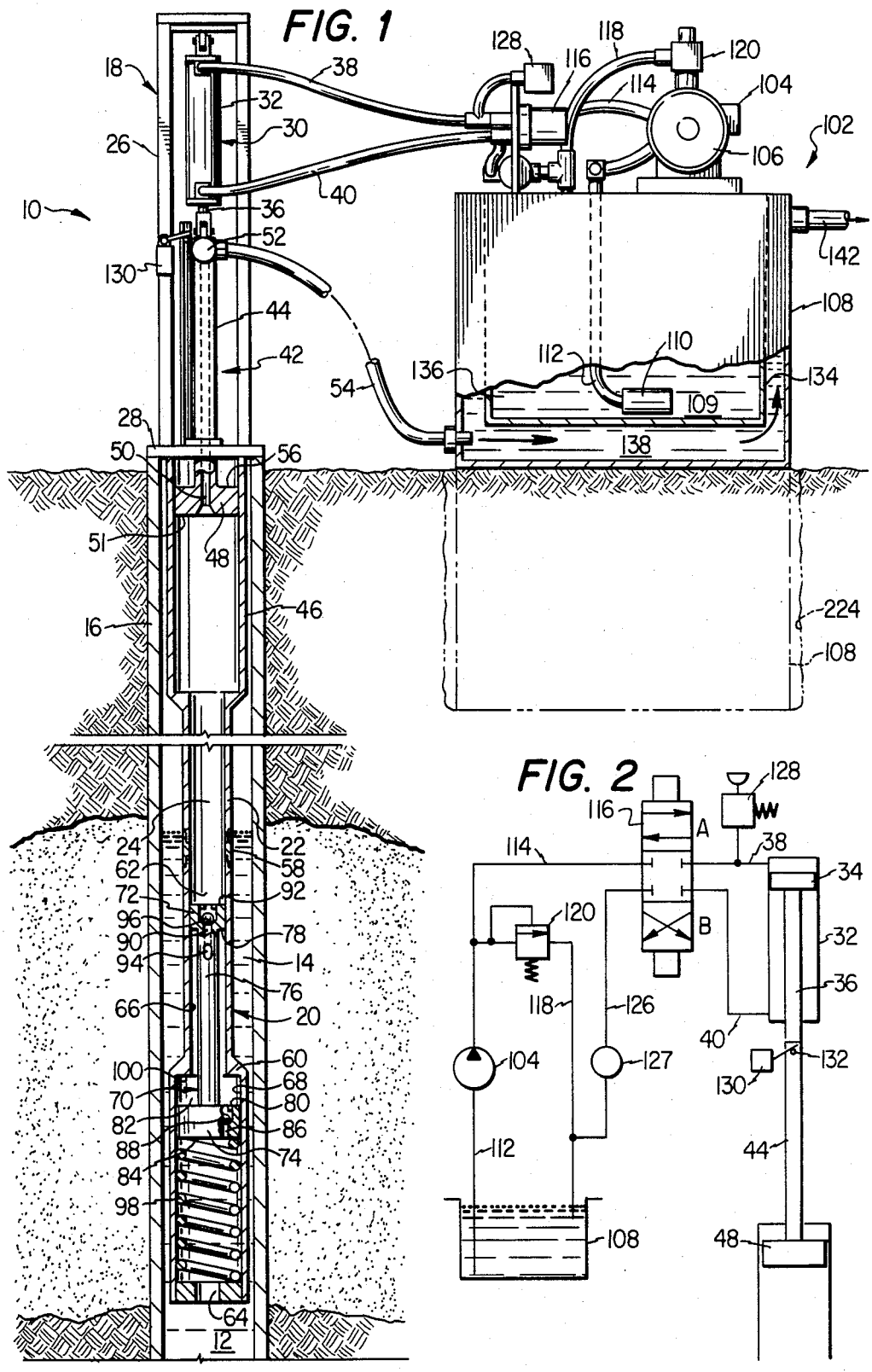
FIG. 1 is a partial cross-sectional view of a pumping apparatus constructed in accordance with the teachings of the present invention.
FIG. 2 is a schematic of the hydraulic system used with the pumping apparatus shown in FIG. 1.
Figure 4:
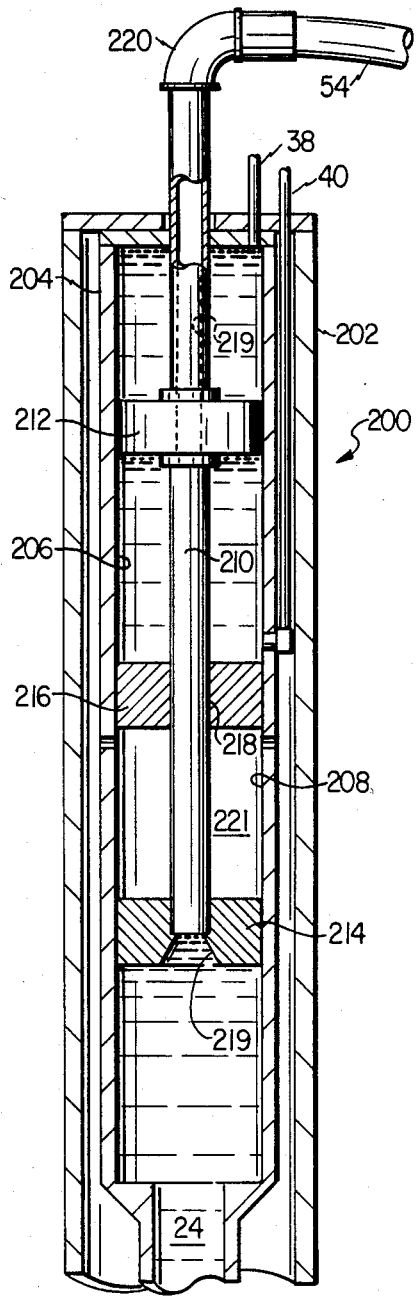
Figure 5:
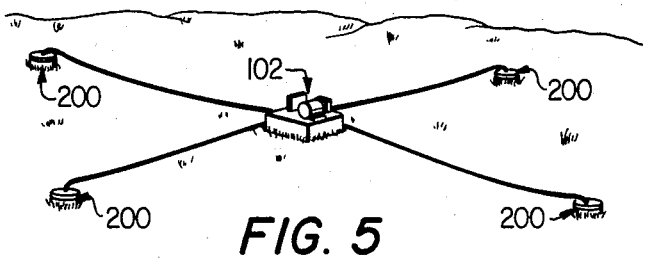

FIG. 4 is a cross-sectional view of the surface mounted pumping unit forming a first modification of the pumping apparatus of FIG. 1; and FIG. 5 is an illustrative view of the ability of the pumping apparatus of the present invention to use a single power unit to operate multiple reservoir and pumping units in multiple wells.

DETAILED DESCRIPTION

Referring now to FIGS. 1–3, a pumping apparatus 10 constructed in accordance with the present invention is illustrated. The pumping apparatus 10 is employed to lift fluid 12 from a reservoir 14 to the surface for further processing. The fluid 12 can be water, oil or any other liquid gas mixture to be pumped from one location to another. In addition, while the pumping apparatus 10 is shown to be lifting the fluid 12 from a conventional well 16, the pumping apparatus 10 will work as well in any other environment where its particular features would be beneficial.

The pumping apparatus 10 consists of three main units, the pumping unit 18 at the surface at the wellhead, the power unit 102 on the surface and the reservoir unit 20 which extends into the reservoir 14 downhole. The pumping and reservoir units 18 and 20 are connected through a conventional tubing string 22 having a passage 24 therethrough.

The pumping unit 18 includes a frame 26 which is mounted over the opening of the well 16 and which includes a cap 28 for closing in the open end of the well. A double acting hydraulic cylinder assembly 30 is mounted on the frame 26 and includes a cylinder 32, a piston 34 for slidable sealed contact with an inner surface of the cylinder 32 and a piston rod 36 connected to the piston 34. Hydraulic hoses 38 and 40 are used for alternately delivering and withdrawing pressurized hydraulic fluid on opposite sides of piston 34 for reciprocating the piston 34 within the assembly 30.

A pulser piston assembly 42 is also mounted on the frame 26, below the hydraulic cylinder assembly 30. The piston rod 36 extends from the cylinder assembly 30 and suitable sealing structure (not shown) is provided about the piston rod 36 so that fluid within the assembly 30 will not escape as the piston rod 36 is reciprocated by the piston 34. The piston rod 36 is connected to a pulser piston rod 44 within the assembly 42. The lower end of the assembly 42 defines a pulser piston cylinder 46. The pulser piston rod 44 extends into the cylinder 46 and defines a pulser piston 48 at the end thereof. The pulser piston 48 is designed for slidable sealing contact with the cylinder 46. The pulser piston rod 44 has a passage 50 formed therethrough which opens through a first side 51 of pulser piston 48. The passage 50 opens into a two-way valve 52 mounted on the side of the assembly 42. The outlet from valve 52 is connected to a production line 54. The valve 52 is moved by conventional means such as an electric relay switch (not shown).

The pulser piston cylinder 46 is connected to the tubing string 22 so that the lower end of the cylinder 46 opens into the passage 24 of the tubing string 22. The second side 56 of the pulser piston 48 is opened to the atmosphere. When the two-way valve 52 is closed, preventing fluid flow through the valve, movement of the piston 34 will move the pulser piston 48 downward to pressurize the fluid within the tubing string. When the two-way valve 52 is opened, fluid within the tubing string 22 is free to pass through passage 50, through the valve 52 and along the production line 54.

The reservoir unit 20 is at least partly submerged within the reservoir 14 at the bottom of the well 16. The reservoir unit 20 is coupled to the lower end of the tubing string 22 by any suitable coupling 58.

The reservoir unit 20 includes a housing 60 which defines an interior 62 open to the passage 24 in the tubing string 22 at its upper end and opened to the fluid within the reservoir 14 at its lower end through a port 64. The walls of the housing 60 forming the interior define a top cylinder wall 66 and a bottom cylinder wall 68. The cross-sectional area of the bottom cylinder 68 is greater than the cross-sectional area of the top cylinder 66 measuring the area generally perpendicular to the vertical center line of the reservoir unit 20.

A piston assembly 70 is positioned within the housing 60 for reciprocation along the vertical center line of the housing. The piston assembly 70 includes a top piston 72 in sliding seal contact with top cylinder wall 66 and a bottom piston 74 in sliding sealed contact with the bottom cylinder wall 68. The top piston 72 and bottom piston 74 are rigidly interconnected by a connecting rod 76 so that the pistons 72 and 74 move simultaneously. As will be apparent from the difference in cross section of the pistons 72 and 74, the piston 74 will sweep through a larger volume within the interior 62 than the top piston 72.

The inner side 78 of the top piston 72, the inner face 80 of a bottom piston 74 and the walls of housing 60 therebetween define a storage chamber 82 which varies in volume as the pistons move within the housing 60. Generally, as the piston assembly moves in the downward direction from the rest position with the inner face 80 abutting the annular wall 100 between the walls 66 and 68, the volume of the storage chamber 82 increases.

The outer face 84 of the bottom piston 74 is exposed to the liquid from the reservoir which enters the port 64. Passages 86 are formed in the bottom piston 74 and open through both the inner and outer faces 80 and 84. A check ball 88 is placed in each of the passages 86 which is designed to cooperate with a valve seat formed on the walls of the passage 86 to create a check valve which permits fluid to flow from the reservoir into the storage chamber 82 when the fluid pressure in the reservoir exceeds fluid pressure in the storage chamber. However, the ball 88 will seat on the wall passage 86 to prevent flow from the storage chamber back to the reservoir.

The connecting rod 76 which connects the top piston 72 and bottom piston 74 has a passage 90 formed through a portion thereof as seen in FIG. 1 which opens through the outer face 92 of the top piston 72 and through a production port 94 which opens into the storage chamber 82. A check ball 96 is provided in the passage 90 and they form a check valve which permits fluid to flow from the storage chamber 82 to the passage 24 in the tubing string and prevents the reverse flow.

A helical spring 98 is provided in the housing 60 and acts between the lower end of the housing and the outer face 84 of the bottom piston 74. The helical spring 98 urges the piston assembly 70 into the rest position or static equilibrium of the spring, typically with the inner face 80 of the bottom piston 74 proximate to, but not contacting the annular wall 100 which is formed between the cylinder walls 66 and 68. When the piston assembly 70 is urged downwardly, the helical spring 98 is compressed and absorbs potential energy in the compression thereof which provides the energy for pumping reservoir fluid to the surface, as will be described hereinafter.

A power unit 102 is mounted on the surface which provides the energy for the pumping action of the pumping apparatus 10. The power unit 102 includes a hydraulic pump 104 which is driven by a motor 106, typically an electric motor. The motor and pump are mounted on a reservoir 108 of hydraulic fluid 109. When the pump 104 is operating, hydraulic fluid 109 is sucked through a strainer 110 and through inlet line 112 into the pump. The main supply line 114 extends from the pump to a four-way solenoid valve 16. A bypass line 118 has a pressure relief valve 20 to limit the pressure in the main supply line 114 by recycling pressurized hydraulic fluid to the reservoir 108 when the predetermined pressure set in the pressure relief valve 120 is exceeded.

With particular reference to FIG. 2, the four-way solenoid valve 116 is schematically illustrated. The high pressure hydraulic fluid in the main supply line 114 enters the valve 120 and can be directed either through the upper line 38 when valve 116 is in position A to act against the piston 34 and drive the piston and piston rod 36 downward, or through the lower line 40 when valve 116 is in position B to act against the bottom of the piston 34 to drive the piston 34 and piston rod 36 upward. In either case, the fluid on the side of the piston opposite the side acted on by the high pressure is returned to the reservoir by the return line 126 which has a filter 127 for return to the reservoir 108.

A pressure switch 128 is mounted in the upper line 38 and is activated when the hydraulic pressure in the upper line 38 reaches a predetermined pressure. A limit switch 130 is mounted on the frame 26 and is activated by a peg 132 when the piston 34 is adjacent to the top of the cylinder 32 in its rest position. The piston 34 is capable of moving downward near the bottom of the cylinder 32 to its fully extended position.

The reservoir 108 is defined with an inner wall 134 which defines the actual container 136 for holding the supply of hydraulic fluid 109. A space 138 is provided between the inner wall 134 and the outer wall 140 for passage of fluid 12 pumped from the reservoir. The hydraulic fluid 109 is cooled by the passage of the pumped fluid through the space 138 while assuring that the hydraulic fluid and liquid 12 do not mix. The pumped fluid is provided through the production line 54 to the space 138 and exits through a production line 142 to a collection location, such as a storage tank.

With reference now to FIGS. 1, 2, 3*a* and 3*b*, the operation of the pumping apparatus 10 will be described. Initially, the hydraulic piston 34 will be in its rest position near the top of the cylinder 32. The helical spring 98 will be in its rest or static equilibrium position with face 80 of lower piston 74 proximate the annular wall 100. The four-way valve 116 will be in position A and the two-way valve 52 will be closed.

Figure 3A:
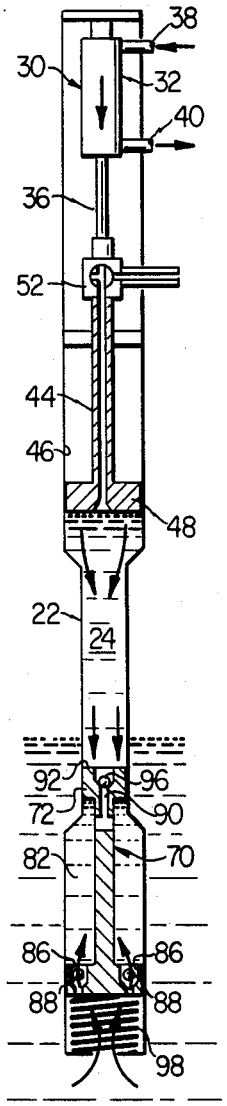

When pressurized hydraulic fluid is provided from the pump 104 through upper line 38 as seen in FIG. 3*a*, the hydraulic fluid acts against the piston 34 to drive the piston 34 toward its fully extended position near the bottom of the cylinder 32. The connection between the piston rod 36 and pulser piston rod 44 will cause the pulser piston 48 to simultaneously move downward along the pulser piston cylinder wall 46. As pulser piston 48 moves downward, it pressurizes the fluid 12 present in the passage 24 of the tubing string 22. The pressurized fluid in passage 24 acts against the outer face 92 of the top piston 72 and moves the piston assembly 70 away from its rest position. As seen in FIG. 3*a*, as the piston assembly 70 is moved away from its rest position, the volume of the storage chamber 82 increases, thereby causing the fluid pressure in the reservoir to exceed the fluid pressure in the storage chamber 82 and allowing fluid to move through the passages 86 of the reservoir to the storage chamber 82. As the piston assembly 70 moves farther away from the rest position, the helical spring 98 is compressed to exert an ever greater force acting to return the piston assembly 70 to the rest position.

Figure 3B:
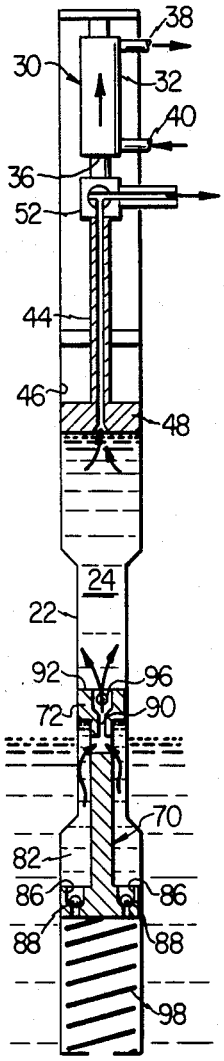

The piston 34 moves downwardly in the cylinder 32 until the increasing resistance to movement, caused by the compression of helical spring 98, raises the hydraulic pressure to the predetermined pressure which activates the pressure switch 128. The movement of the piston 34 is therefore determined by the movement necessary to move the piston assembly 70 from its rest position to a predetermined or pumping position with the helical spring 98 compressed to contain the desired potential energy. When the pressure switch 128 is activated by the hydraulic pressure reaching the predetermined pressure, the four-way solenoid valve 116 is reversed to position B and the two-way valve 52 is opened. The high pressure hydraulic fluid from main supply line 118 therefore is directed through the lower line 40 to lift the piston 34 back to its rest position, as well as lifting the pulser piston 48 upward. As the force of the pulser piston 48 is released from the fluid in the passage 24, the potential energy stored in the spring 98 drives the piston assembly 70 upward toward the rest position as seen in FIG. 3*b* against only the static head of the fluid in the well 16. As the piston assembly 70 is driven upwardly, the volume of the storage chamber 82 rapidly decreases, pressurizing the fluid in the storage chamber 82. The ball 88 is sealed against the ball seat in the passages 86 while the ball 96 is lifted off the ball seat in the passage 90 and fluid from the storage chamber 82 is pumped through production port 94, passage 90, up passage 24 and through valve 52 to the production line 54. The natural bounce of the spring 98 causes the spring 98 to expand beyond its rest or static position, urging the piston assembly 70 above its position when the spring 98 is at rest. Preferably, even in bounce, the face 80 will not hit wall 100. Therefore, the actual travel of the spring in rebounding from its compressed state exceeds the travel in compressing the spring, resulting in an increase in pumping efficiency. The spring 98 subsequently rebounds to its rest position in a series of oscillations at the natural frequency of the spring 98 within the reservoir unit 20. Ideally, the operation of pumping unit 18 is related to this natural frequency to obtain the maximum benefit from the spring expansion. As can be seen, the potential energy stored in the compression of the helical spring 98 actually forms the direct pumping force for lifting the liquid from the reservoir to the surface. The pumping apparatus 10 is therefore much less sensitive to gas locking than prior devices. The piston 34 is simply moved downwardly from the rest position a sufficient distance to compress the helical spring 98 the desired amount, corresponding to the increase in the hydraulic fluid pressure to the predetermined pressure sensed by the pressure switch 128. The stroke of the piston 34 between the rest position and the fully extended position is sufficiently long to permit the pump to operate even with the presence of gas in the fluid 12 being pumped to the surface.

As the piston 34 returns to the rest position, the peg 132 activates the limit switch 130 to close the two-way valve 52, move the four-way solenoid valve 116 to position A and begin the pumping cycle anew.

FIG. 4 illustrates a first modification of the pumping apparatus 10 and comprises a consolidated pumping unit 200. The consolidated pumping unit includes an outer shell 202 which corresponds to the frame 26. An inner shell 204 is centered within the outer shell 202 and defines a hydraulic cylinder wall 206 and a pulser piston cylinder wall 208. The upper line 38 and lower line 40 enter through the top of shells 202 and 204 and open into the hydraulic cylinder wall 206 at opposite ends. The passage 24 into the tubing string 22 opens into the cavity formed by the pulser piston cylinder wall 208.

A connecting rod 210 has a hydraulic piston 212 mounted therealong and a pulser piston 214 mounted at one end thereof. The piston 212 has suitable seals for slidable seal contact with the hydraulic cylinder wall 206 and the pulser piston 214 has suitable sealing material to provide a slidable seal contact between the pulser piston 214 and the pulser piston cylinder wall 208. An annular divider 216 divides the cylinder walls 206 and 208 and has a passage 218 through which the connecting rod 210 passes. Suitable sealing structures provide to seal the connecting rod for sliding movement within the passage 218 to prevent hydraulic fluid and fluid 12 from being cross contaminated. The connecting rod 210 extends upwardly from the piston 212 and through openings formed in the inner and outer shells 202 and 204. Again, suitable sealing structure is provided for a slidable seal between the connection rod 210 and the shells 202 and 204. A passage 219 is formed through the connection rod 210 which opens through the face of the pulser piston 214 exposed to the fluid 12 and opens at the opposite end outside the pumping unit 200. An elbow 220 is secured to the exposed end and directs fluid pumped through the passage 219 to the production line 54. In operation, the consolidated pumping unit 200 operates in a substantially identical manner to the pumping unit 18. The connecting rod 210 reciprocates with the pistons 212 and 214 through the entire range of motion necessary to provide adequate pumping action in the downhole reservoir unit 20. The chamber 221 above the pulser piston 214 and below the divider 216 is open to the atmosphere through ports 222. The consolidated pumping unit 200 can actually be inserted completely within the well 16 to minimize the surface structure, as shown in FIG. 5.

FIG. 5 illustrates another significant advantage of the apparatus 10 which allows a single power unit 102 to be used with a number of pumping units 18 or 200 and reservoir units 20. This permits a single power unit 102 to operate multiple pumping unit 18 or 200 and reservoir units 20. Therefore a single power unit 102 can simultaneously pump fluid from multiple well 16. All that is necessary is to route the various control and hydraulic flow lines from the power unit 102 to the various pumping units 18 as shown in FIG. 5.

If desired, the pumping apparatus 10 can be made even less obtrusive on the surface by digging a pit 224 and placing the reservoir 108 therein as shown in dotted lines in FIG. 1. The presence of the reservoir within the ground also further acts to cool the hydraulic fluid.

As can be seen, the pumping apparatus 10 represents a number of improvements over the prior pumping designs. The pumping apparatus 10 is much less sensitive to gas locking than prior pumps. Pumping apparatus 10 permits the movement of the hydraulic piston 34 to be varied as necessary to overcome the presence of gas in the tubing string 22 to insure that there is a uniform movement of the piston assembly 70 downhole and a uniform compression of the helical spring 98, which actually acts to pump the fluid from the reservoir to the surface when the potential energy stored in the helical spring 98 is released as the piston assembly 70 moves back to the rest position. For example, depending on the presence of gas within the tubing string, the stroke of the hydraulic piston 34 could vary between 2 inches and 8 inches to achieve a desired predetermined pressure of 500 psi. Naturally, the absolute pressure of the fluid increases because of hydrostatic force downward towards the reservoir unit 20 but the pressure increase due to the movement of the hydraulic piston 34 and pulser piston 48 is directly translated into movement of the piston assembly 70 and compression of the helical spring 98 downhole. Pumps constructed in accordance with the teachings of the present invention are fully capable of pumping fluid from a depth of 5,000 feet at a rate of 300 barrels per day. This performance level is adequate for most pumping applications that a pump jack would be used for. The advantage of using the pumped liquid to cool the hydraulic fluid can permit the quantity of hydraulic fluid in reservoir to be reduced as much as 75 percent relative to a non-cooled hydraulic reservoir.

Whereas the present invention has been described with respect to a specificate embodiment thereof, if will be understood that various changes and modifications will be suggested to one skilled in the art and is intended to encompass such changes and modifications that fall within the scope of the appended claims.

We claim:

1. A pumping apparatus for pumping a fluid from a reservoir to a collection location, tubing interconnecting the reservoir and collection location, comprising:

a reservoir unit including:

(a) a housing secured to said tubing, the interior of the housing being a fluid communication with the passage in the tubing, the interior of the housing defining a top cylinder and a bottom cylinder, the cross section of the bottom cylinder being larger than the cross section of the top cylinder;

(b) a piston assembly including a top piston having an outer face and an inner face for sliding sealed motion along the top cylinder of the housing, a bottom piston having an outer face and an inner face for sliding sealed motion along the bottom cylinder of the housing and a member interconnecting the top and bottom pistons so that the top and bottom pistons move jointly, the inner face of the top and bottom pistons and housing defining a storage chamber therebetween, the outer face of the top piston being exposed to fluid in the passage of the tubing, the outer face of the bottom piston being exposed to fluid in the reservoir through an opening formed in the housing permitting fluid from the reservoir to enter the interior of the housing, the piston assembly being movable relative the housing from a rest position to increase the volume of the storage chamber;

(c) spring means acting between the housing and piston assembly for urging the piston assembly to the rest position, movement of the piston assembly from the rest position causing potential energy to be stored within said spring means to increase the force exerted by said spring means on the piston assembly to move the piston assembly to the rest position;

(d) first check valve means for permitting flow of fluid from the reservoir to the storage chamber when the storage chamber fluid pressure is less than the reservoir fluid pressure and preventing reverse flow;

(e) second check valve means for permitting flow of fluid from the storage chamber to the passage in the tubing when the storage chamber of fluid pressure exceeds the fluid pressure in the passage in the tubing and preventing reverse flow; and a pumping unit positioned along the tubing remote from the reservoir unit comprising:

(a) a pulser piston having a first face;

(b) structure defining a pulser piston cylinder, the pulser piston for sliding sealed motion along the pulser piston cylinder, the structure being secured to the tubing so that the first face of the pulser piston is in fluid communication with the fluid in the passage in the tubing;

(c) a valve positioned in the tubing operable between closed and open positions, the valve in the closed position stopping flow through the passage in the tubing and in the open position allowing flow through the passage in the tubing;

(d) pumping means for moving the pulser piston in a first direction relative to the pulser piston cylinder with the valve closed to pressurize the fluid in the passage in the tubing between the valve and reservoir unit to a predetermined pressure, the predetermined pressure acting against the outer face of the top piston to move the piston assembly away from the rest position, the volume of the storage chamber increasing with fluid from the reservoir passing through the first check valve means to the storage chamber, the movement of the piston assembly from the rest position storing potential energy in the spring means, said pumping means further for permitting the pulser piston to move in the opposite direction relative the pulser piston cylinder with the valve opened, the spring means urging the piston assembly to the rest position, causing the storage chamber to reduce in volume and pump fluid from the storage chamber through the second check valve means and valve to the collection location.

2. The pumping apparatus of claim 1 wherein the movement of the pulser piston is sufficient to pressurize the fluid in the passage of the tubing to the predetermined pressure despite the presence of gas in the fluid.

3. The pumping apparatus of claim 1 wherein said pumping means further comprises a double acting hydraulic cylinder having a hydraulic piston reciprocal therein;

means for connecting the hydraulic piston and the pulser piston so that movement of the hydraulic piston in a first direction causes the pulser piston to compress the fluid in the passage in the tubing; and control means for providing pressurized hdydraulic fluid to a first face of the hydraulic piston to move the hydraulic piston and pulser piston until the predetermined pressure is achieved and subsequently entering pressurized hydraulic fluid to act on the opposite side of the hydraulic piston to return the hydraulic piston.

4. The pumping apparatus of claim 3 wherein said control means includes a hydraulic reservoir for containing a reservoir of hydraulic fluid, said hydraulic reservoir having a passage therein to permit the fluid pumped from the reservoir to pass therethrough and cool the hydraulic fluid.

5. The pumping apparatus of claim 3 wherein said control means is operable to control multiple reservoir units, pulser pistons and double acting hydraulic pistons so that fluids can be simultaneously pumped from multiple reservoirs.

6. A pumping apparatus for pumping a fluid from a reservoir to a collection location, a tubing string having a passage therethrough interconnecting the reservoir and collection location, comprising:

a reservoir unit including:

(a) a housing secured to said tubing string and entering the reservoir, the housing defining an interior thereof in fluid communication with the passage in the tubing and the fluid in the reservoir through a port formed in the housing, the interior of the housing defining a top cylinder wall and a bottom cylinder wall;

(b) a piston assembly including a top piston having an outer face and an inner face for sliding sealed motion along the top cylinder wall of the housing, a bottom piston having an outer face and an inner face for sliding sealed motion along the bottom cylinder wall of the housing and a member interconnecting the top and bottom pistons for joint movement along the cylinder walls, the inner faces of the top and bottom pistons and housing therebetween defining a storage chamber, the outer face of the top piston being exposed to the fluid in the passage in the tubing string, the outer face of the bottom piston being exposed to the fluid in the reservoir through the port in the housing permitting fluid from the reservoir to enter the interior of the housing, the piston assembly being movable relative the housing from a rest position in a first direction, the swept volume of the bottom piston being greater than the swept volume of the top piston as the piston assembly moves from the rest position in the first direction to increase the volume of the storage chamber;

(c) a resilient spring acting between the housing and piston assembly for urging the piston assembly to the rest position, movement of the piston assembly in first direction compressing the spring and storing potential energy in the spring which increases the force exerted by the spring to urge the piston assembly to the rest position;

(d) at least one first check valve assembly including a passage between the outer and inner faces of the bottom piston and means for permitting flow through the passage from the reservoir to the storage chamber when the fluid pressure in the reservoir exceeds the fluid pressure in the storage chamber and preventing reverse flow;

(e) a second check valve assembly for permitting fluid flow from the storage chamber to the passage in the tubing string when the pressure in the storage chamber exceeds the fluid pressure in the passage in the tubing string;

a pumping unit positioned at the opposite end of the tubing string from the reservoir, including:

(a) a pulser piston having a first face;

(b) structure defining a pulser piston cylinder wall, the pulser piston for sliding sealed motion along the pulser piston cylinder wall, the structure being secured to the tubing string so that the first face of the pulser piston is in fluid communication with the fluid in the tubing;

(c) a valve having an inlet side opened to the fluid to the passage in the tubing string and an outlet side for delivering fluid to the collection location, the valve being operable between closed and open positioned, the valve in the closed position preventing flow from the passage in the tubing string to the collection location and in the open position to permit fluid flow from the tubing string to the collection location;

(d) a double acting hydraulic cylinder assembly including a piston reciprocal within the hydraulic cylinder assembly from a rest position to a fully extended position, a hydraulic piston rod connecting the hydraulic piston to the pulser piston so that movement of the hydraulic piston from the rest position towards the fully extended position causes the pulser piston to pressurize the fluid within the tubing string;

(e) means for sensing movement of the hydraulic piston to the rest position;

a power unit including:

(a) means for providing pressurized hydraulic fluid;

(b) a reservoir for supplying hydraulic fluid to the means for providing pressurized hydraulic fluid;

(c) a four-way valve operable between a first position for permitting pressurized hydraulic fluid to enter the double acting hydraulic cylinder assembly to move the hydraulic piston from the rest position toward the fully extended position and operable in a second position to move the hydraulic piston toward the rest position, the four-way valve permitting excess hydraulic fluid to return to the hydraulic reservoir; and (d) a hydraulic pressure sensitive switch for sensing when the hydraulic pressure acting on the hydraulic piston to move the hydraulic piston from the rest position achieves a predetermined pressure;

the four-way valve in the power unit being in the first position to move the hydraulic piston from the rest position and move the pulser piston to pressurize the fluid within the tubing string with the valve closed, thereby causing the pressurized fluid in the tubing string to act against the outer face of the top piston of the piston assembly and move the piston assembly from the rest position to compress the spring and cause fluid from the reservoir to enter the storage chamber, the four-way valve being maintained in the first position until the pressure sensitive switch senses a hydraulic pressure equal to the predetermined pressure, upon which event the four-way valve is moved to the second position to move the hydraulic piston to the rest position and open the valve, the potential energy stored in the spring urging the piston assembly to the rest position, causing pressurization of the fluid within the storage chamber and causing fluid in the storage chamber to be pumped through the second check valve assembly and valve into the collection location, the fully extended position of the hydraulic piston providing sufficient stroke in the hydraulic piston to provide adequate pumping action with the piston assembly despite the presence of gas in the fluid and tubing string.

7. The pumping appartus of claim 6 wherein the hydraulic reservoir has an inner shell defining a volume for containing hydraulic fluid and an outer shell, the space between inner and outer shells being filled with the fluid being pumped from the reservoir as it moves to the collection location so that the pumped fluid cools the hydraulic fluid.

8. The pumping apparatus of claim 6 wherein the power unit can be used to operate multiple pumping units and reservoir units so that fluid can be simultaneously pumped from multiple fluid reservoirs.

9. A pumping apparatus for pumping a fluid from a reservoir to a collection agency, a tubing string having a passage therein extending from proximate the reservoir to a remote location, comprising:

a reservoir unit including:

(a) a housing secured to the tubing string proximate the reservoir, the interior of the housing defining a first cylinder wall and a second cylinder wall, the first cylinder wall being proximate the connection between the housing and the passage in the tubing string and the second cylinder wall being proximate a port formed through the housing permitting fluid from the reservoir to enter the housing;

(b) a piston assembly including a first piston having an outer face and an inner face for sliding sealed motion along the first cylinder wall of the housing, a bottom piston having an outer face and an inner face for sliding sealed motion along the second cylinder wall of the housing and a connecting rod rigidly interconnecting the pistons, the inner faces of the first and second pistons and the portions of the cylinder walls therebetween defining a storage chamber, the outer face of the first piston being exposed to the fluid in the passage of the tubing string, the outer face of the second piston being exposed to fluid entering the housing through the port, the piston assembly being movable relative the housing from a rest position to a pumping position, the volume of the storage chamber increasing as the piston assembly moves from the rest position to the pumping position;

(c) a helical spring acting between the housing and the second piston for urging the piston asembly to the rest position, the force exerted by the spring means increasing as the piston assembly is moved from the rest position to the pumping position;

(d) at least one passage formed through the second piston and opening through the inner and outer faces thereof and check valve means in the passage for permitting fluid flow from the reservoir to the storage chamber when the pressure in the fluid reservoir exceeds the pressure in the storage chamber by preventing reverse flow;

(e) a second check valve assembly mounted in a passage formed through the connecting rod which opens into the storage chamber and through the outer face of the first piston for permitting fluid flow from the storage chamber to the passage and tubing string but prevents the reverse flow;

a pumping unit positioned at the remote location from the reservoir and secured to the tubing string, including:

(a) a structure defining a cylindrical pulser piston cylinder wall, the passage in the tubing string opening into one end of the cylinder;

(b) a pulser piston for sliding sealed movement along the pulser piston cylinder wall, a first face of the pulser piston being exposed to the fluid within the passage in the tubing string;

(c) a pulser piston rod having a passage formed therein and opening through the first face;

(d) a two-way valve having an inlet in fluid communication with the passage in the pulser piston rod and an outlet in fluid communication with the collection location, the two-way valve being operable between a closed position preventing fluid flow between the inlet and outlet in an open position permitting flow between the inlet and outlet;

(e) a double acting hydraulic cylinder assembly including a hydraulic cylinder and a hydraulic piston for reciprocation therein between a rest position and a fully extended position, the assembly further having a hydraulic piston rod connected to said pulser piston rod so that movement of the hydraulic piston induces movement of the pulser piston, a first port in the cylinder for entry of pressurized hydraulic fluid to act on the hydraulic piston to move the piston in first direction from the rest position and a second port in the cylinder for entry of pressurized hydraulic fluid for movement of the hydraulic piston in the opposite direction toward the rest position;

(f) a limit switch for sensing movement of the hydraulic piston to the rest position; and a power unit including:

(a) a reservoir for storage of hydraulic fluid;

(b) means for drawing hydraulic fluid from the reservoir and pressurizing the hydraulic fluid;

(c) a four-way valve operable in a first position to provide the pressurized hydraulic fluid through the first port of the hydraulic cylinder while permitting fluid to exit the second port for return to the reservoir and in a second position to provide for pressurized hydraulic fluid through the second port and permit fluid to move through the first port to the reservoir to move the hydraulic piston to the rest position;

(d) a pressure limit switch activated upon pressurization of the hydraulic fluid moving into the first port to a predetermined pressure;

the pumping apparatus operating to pump fluid from the reservoir to the collection location, the four-way valve being in the first position to permit the hydraulic fluid to move the hydraulic piston from the rest position toward the fully extended position with the two-way valve closed, the pulser piston moving along the pulser piston cylinder wall to pressurize the fluid in the tubing string and the pressurized fluid in the tubing string thereupon acting against the outer face of the first piston to drive the piston assembly from the rest position, the piston assembly being moved to the pumping position upon the hydraulic pressure acting on the hydraulic piston reaching the predetermined pressure, the pressure switch thereupon causing the four-way valve to be moved to the second position and opening the two-way valve to permit the hydraulic piston to be moved to the rest position, the potential energy stored in the spring in compressing the spring by movement of the piston assembly into the pumping position causing the fluid in the storage chamber to be driven through the second check valve assembly, tubing string, two-way valve and to the collection location, the hydraulic piston being moved from the rest position only a distance necessary to cause the piston assembly to move from the rest position to the pumping position, the distance being variable in response to the presence of gas in the liquid in the tubing string.

10. The pumping apparatus of claim 9 wherein the fluid pumped from the reservoir passes in thermal communication with the hydraulic fluid to cool the hydraulic fluid.

11. The pumping apparatus of claim 9 wherein said power unit is used to operate multiple pumping units and reservoir units to simultaneously pump fluid from the multiple reservoir units to the collection location.

* * * * *

UNITED STATES PATENT AND TRADEMARK OFFICE

CERTIFICATE OF CORRECTION

PATENT NO. : 4,616,981

DATED : October 14, 1986

INVENTOR(S) : Eugene D. Simmons, et al

It is certified that error appears in the above-identified patent and that said Letters Patent is hereby corrected as shown below:

On the title page inventors should read

-- (54) Inventors: Eugene D. Simmons, 1108 N. Pennsylvania; Graham C. Thomson, III, 1502 N. Ohio; Richard J. Reynaud, 1502 N. Ohio; all of Roswell, N. Mex. 88201; Phillip R. Smith, 325 Capri Ave; Las Cruses, New Mex. 88005; Thomas R. Mancini, 9017 Confederate North East; Albuquerque, New Mex. 87109, Donald L. Fenton, 4820 Senita Road, Las Cruses, New Mex. 88001, Leo J. La France, 1356 Esperanza Street, Las Cruses, New Mex. 88001--.

Signed and Sealed this

Fourteenth Day of April, 1987

*Attest:*

DONALD J. QUIGG

*Attesting Officer*

*Commissioner of Patents and Trademarks*